US009380850B1

(12) United States Patent
Krok et al.

(10) Patent No.: US 9,380,850 B1
(45) Date of Patent: Jul. 5, 2016

(54) SAFETY RAZOR HOLDER WITH ZINC STRIP TO REDUCE CORROSION OF THE RAZORBLADES

(71) Applicants: Paul Krok, Culver City, CA (US); Brian Steinhobel, Sandton (ZA)

(72) Inventors: Paul Krok, Culver City, CA (US); Brian Steinhobel, Sandton (ZA)

(73) Assignee: Bonfit America Inc., Culver City, CA (US)

( * ) Notice: Subject to any disclaimer, the term of this patent is extended or adjusted under 35 U.S.C. 154(b) by 0 days.

(21) Appl. No.: 14/972,022

(22) Filed: Dec. 16, 2015

(51) Int. Cl.
*A45D 27/22* (2006.01)

(52) U.S. Cl.
CPC ..... *A45D 27/225* (2013.01)

(58) Field of Classification Search
USPC ..... 206/349, 352, 353, 354, 355, 356, 357
See application file for complete search history.

(56) References Cited

U.S. PATENT DOCUMENTS

| | | | | |
|---|---|---|---|---|
| 2,551,859 | A | 5/1951 | Thompson | |
| 3,759,594 | A | 9/1973 | Cobb | |
| 7,188,724 | B1 * | 3/2007 | Crain | B25H 3/006 190/18 A |
| 8,113,347 | B2 | 2/2012 | Kohring et al. | |
| 8,342,322 | B2 | 1/2013 | De'Rennaux | |
| 8,770,398 | B1 | 7/2014 | Krok | |
| 2004/0099554 | A1 * | 5/2004 | Pangerc | B25H 3/023 206/349 |
| 2009/0172958 | A1 | 7/2009 | Prudden et al. | |
| 2011/0197450 | A1 * | 8/2011 | Taub | B26B 21/521 30/50 |
| 2011/0225834 | A1 * | 9/2011 | Cirilli | A45D 27/29 30/541 |
| 2012/0125793 | A1 * | 5/2012 | Benvenuto | A45D 27/24 206/349 |
| 2013/0047860 | A1 | 2/2013 | Lawhorne | |
| 2014/0083052 | A1 * | 3/2014 | Cosper | A45D 27/46 53/428 |
| 2015/0034515 | A1 * | 2/2015 | Monyak | E21C 35/183 206/349 |

* cited by examiner

*Primary Examiner* — Jacob K Ackun
(74) *Attorney, Agent, or Firm* — Thomas I. Rozsa

(57) ABSTRACT

A container used in conjunction with a safety razor including a razorblade cartridge which in turn retains at least one razorblade having a sharp front edge within the container. The container includes a zinc metal strip within the container against which at least one of the razorblades from the safety razor are forced into contact with the zinc metal strip and the remaining blades are in close proximity to the zinc metal strip. It is within the spirit and scope of the present invention for the cartridge to retain any multiplicity of razorblades, with each respective razorblade having a sharp edge either forced to be against the zinc metal strip or adjacent the zinc metal strip.

16 Claims, 13 Drawing Sheets

SAFETY RAZOR HOLDER WITH ZINC STRIP TO REDUCE CORROSION OF THE RAZORBLADES

BACKGROUND OF THE INVENTION

1. Field of the Invention

The present invention relates to the field of retainers for retaining a safety razor and with shaving blade cartridge attached to the handle so that the safety razor is in condition for immediate shaving use when it is removed from the container.

2. Description of the Prior Art

The following seven patents and published patent applications are the closest prior art references which were located in a prior art search.

1. U.S. Pat. No. 2,551,859 issued to Marcus C. Thompson on May 8, 1951 for "Razor Supporting Means" (hereafter the "Thompson Patent");

2. U.S. Pat. No. 3,759,594 issued to Jack M. Cobb on Sep. 18, 1973 for "Method and Apparatus for Storing Cutting Implements" (hereafter the "Cobb Patent");

3. United States Published Patent Application No. 2009/0172958 to John Prudden et al. on Jul. 9, 2009 for "Pivot Inhibiting Razor Storage Case" (hereafter the "Prudden Published Patent Application");

4. U.S. Pat. No. 8,113,347 issued to Douglas Robert Kohring et al. on Feb. 14, 2012 for "Razor Storage Case Having Mating Closure Members" (hereafter the "Kohring Patent");

5. U.S. Pat. No. 8,342,322 issued to Darrell R. De'Rennaux on Jan. 1, 2013 for "Razor Bed" (hereafter the "De'Rennaux Patent");

6. United States Published Patent Application No. 2013/0047860 to Charles Allan Lawhorne on Feb. 28, 2013 for "Anti-Rust Case (ARC)" (hereafter the "Lawhorne Published Patent Application");

7. U.S. Pat. No. 8,770,398 issued to Paul Krok on Jul. 8, 2014 for "Retaining Disposable Shaver Blade Cartridges in a Sealed Condition and Simultaneously Retaining the Shaver Handle in a Condition for Immediate Shaving Use" (hereafter the "Krok Patent").

The Thompson Patent discloses a razor supporting means. This primarily is disclosing a razor supporting structure to enable the razor to dry.

The Cobb Patent discloses the general concept of a container where the razorblades are placed against the substance that will prevent them from corroding and otherwise deteriorating. The patent discloses:

> "A method and apparatus for storing cutting implements that substantially eliminates deterioration of the cutting edge and metal surfaces adjacent to the cutting edge caused by corrosion of the metal between intermittent uses of the cutting implement. The apparatus comprises a container adapted to receive the cutting implement and support it so that the cutting edges are in close proximity to a body of volatile corrosion inhibitor, which can be a wicking material impregnated with a liquid agent or a body of solid agent. One embodiment of the device is especially adapted for storage of a safety razor between intermittent shaving operations."

The Prudden Published Patent Application discloses a pivot inhibiting razor storage case. The patent application discloses a spring loaded case on a living hinge where the shaver and blades are retained within the case and openings within the case so that a wet razorblade can be dried.

The Kohring Patent discloses a razor storage case having mating closure members with the intent of clearly removing moisture from the razorblade that is contained within the container which also presumably is also attached to a safety razor handle.

The De'Rennaux Patent discloses the concept of having a razor saver that includes an absorbent liner and one or more absorbent desiccant gel packs for removing moisture from the razorblade. The Patent discloses the concept of having only the desiccant to remove the moisture.

The Lawhorne Published Patent Application discloses an anti-rust case. The patent application discloses: a case which contains oxygen and moisture absorbing desiccant. The desiccant, being activated clay, silica gel, and molecular sieve, is contained inside the case along with products that need to remain free of rust. The main object of the case is to prevent rust from forming on the blades of a manual shaver or straight razor. The main components of this product are the case, which restrict air flow, and the desiccant which absorb oxygen and moisture.

The current inventors are also the co-inventors of two issued United States patents. The first issued patent is U.S. Pat. No. 8,757,370 issued on Jun. 24, 2014 for "Retaining Disposable Shaver Blade Cartridges in a Sealed Condition and Simultaneously Retaining the Shaver Handle in a Condition for Immediate Shaving Use". The second issued patent for which the present inventors are also co-inventors is U.S. Pat. No. 8,770,398 issued on Jul. 8, 2014 for "Retaining Disposable Shaver Blade Cartridges in a Sealed Condition and Simultaneously Retaining the Shaver Handle in a Condition for Immediate Shaving Use" which contains additional information on a desiccant within the container.

SUMMARY OF THE INVENTION

The present invention is a container that retains a safety razor including a razorblade cartridge which in turn retains at least one razorblade having a sharp front edge within the container. A handle portion of the safety razor which is attached to the razorblade cartridge has a first portion within the container and a second portion extending out of the container on an arcuate handle support base.

The container is a spring-biased container to keep it closed and it is necessary to provide a force that overcomes the spring force to open the container so that the handle and attached razorblade cartridge with at least one razorblade can be removed from the container which then snaps shut due to the closing spring force. When used throughout this patent application, the apparatus which provides the closing spring force is generally referred to as a closing force member. The closing force is created by spring members selected from the group consisting of a coil spring assembly and a left spring assembly. The safety razor with at least one razorblade with the sharp edge is ready for use.

A key innovation in this invention is the inclusion of zinc strip within the container against which at least one of the razorblades from the safety razor are forced into contact with the zinc metal strip and the remaining blades are in close proximity to the zinc metal strip. It is within the spirit and scope of the present invention for the cartridge to retain any multiplicity of razorblades, with each respective razorblade having a sharp edge either forced to be against the zinc metal strip or adjacent the zinc metal strip. For a cartridge with at least one razorblade with a sharp front edge, the sharp front edge can either be forced against the zinc metal strip or forced to be adjacent the zinc metal strip. It is also within the spirit and scope of the present invention for the container to be used with only the cartridge and at least one razor-blade having a sharp edge and without the handle. The zinc reduces oxidation, corrosion and other chemical reactions to thereby significantly reduce deterioration of the razor-blades. The spring closing action of the retaining case further forces the razor-blades to be against or in close proximity to the zinc strip.

It is therefore an object of the present invention to provide a spring-biased closed sealed container which contains a closing force member including a spring-biased mechanism on its rear to close the container. The container has an interior chamber in which is retained a strip of metal made of zinc with at least one razorblade cartridge forced against the strip of metal made of zinc. The at least one razorblade cartridge is attached to a handle which is partially within the container and partially extends out of the container, the safety razor retained in a manner so that the safety razor is ready for immediate use when the container is opened by a force which overcomes the closing spring force. The innovation is two-fold. First, the container is spring-biased closed so that a handle for a multiplicity of safety razorblade cartridges can be retained with the pointed end of the blades facing downwardly and securely retained against the metal strip made of zinc to reduce oxidation and corrosion of the razorblades and enables the razorblades to remain in a sharp condition. Through overcoming the spring biasing force by pressing on the back of the container, the back of the cartridge is exposed and the handle of a safety razor which is attached to the razorblade cartridge can then be removed so that the container can be closed after the razorblade cartridge and attached handle have been removed.

It is a further object of the present invention to provide a container which retains the razorblades in the razorblade cartridge against or in close proximity to a zinc strip to reduce oxidation, corrosion and other chemical reactions which deteriorate the razorblades. In addition, the container retains the razorblade cartridge and attached handle in an in-use condition, so that the safety razor can be used for shaving purposes without having to hand touch the razorblades or the cartridges and accidently cut a finger.

It is a further object of the present invention to provide a zinc strip within the interior chamber of the container with a spring biasing force causing the container to remain closed and also forcing the cartridge containing the razorblades to be in contact with or adjacent the zinc strip.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
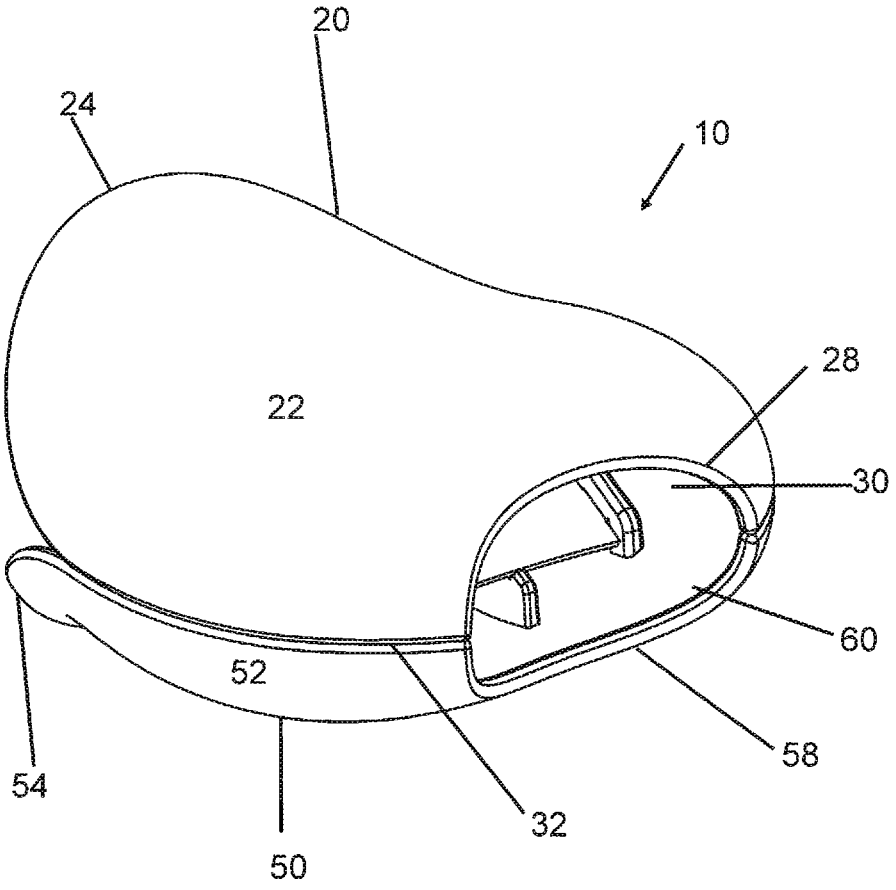
FIG. 1 is an exterior top-front perspective view of the present invention safety razor holder with zinc strip to reduce corrosion of the razorblade, showing a new design for the exterior of the container for which the present inventors have applied for a design patent.
Figure 2:
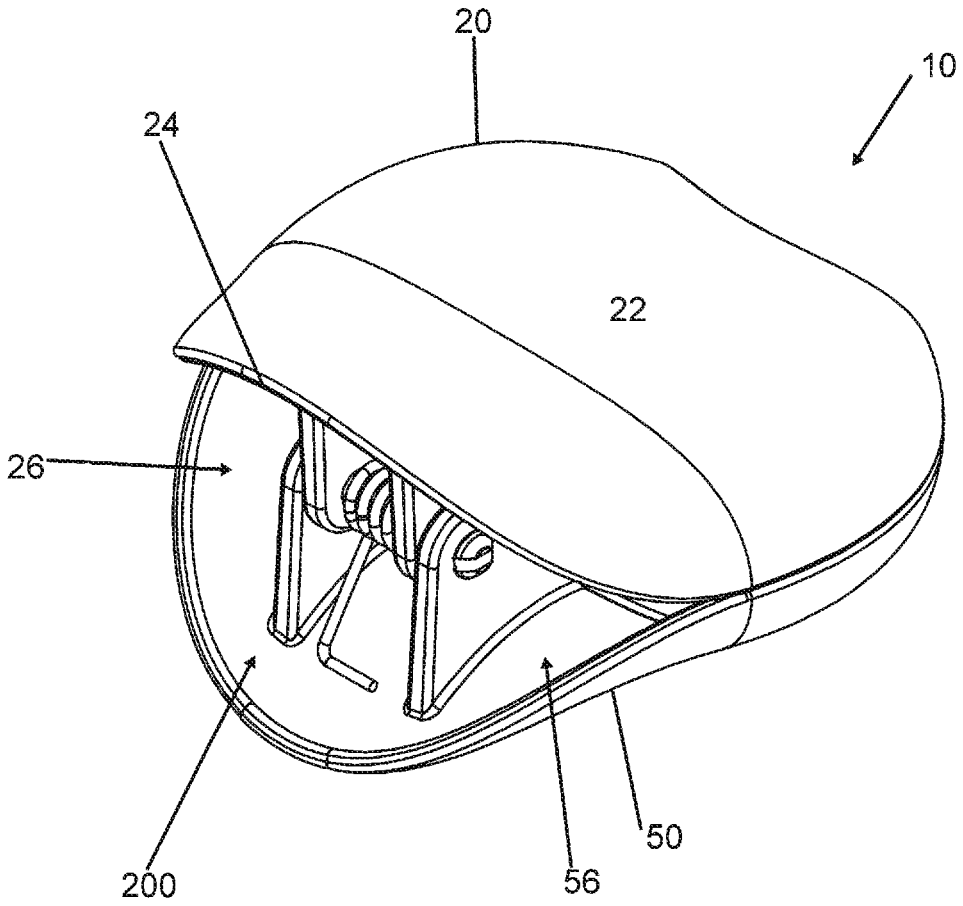
FIG. 2 is an exterior top rear perspective view of the present invention container.
Figure 3:
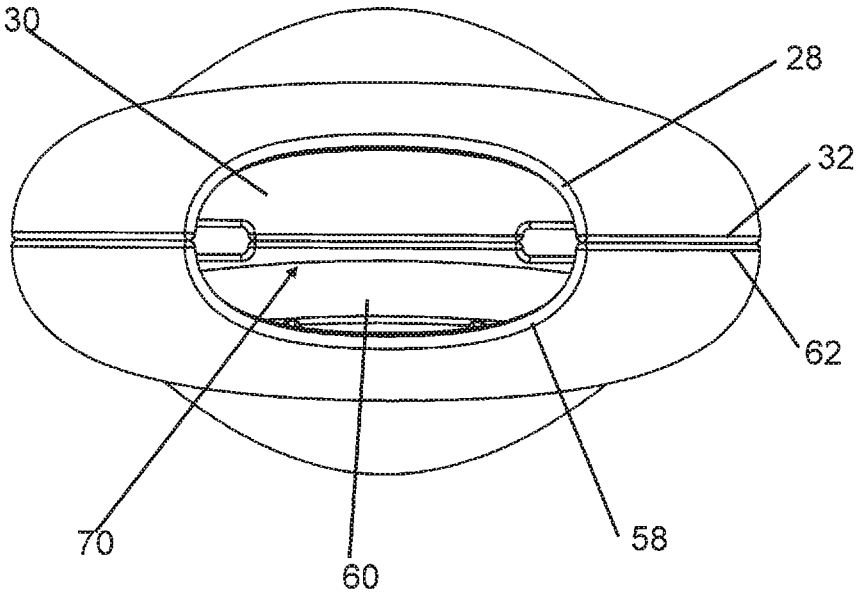
FIG. 3 is an exterior front view of the present invention container.
Figure 4:
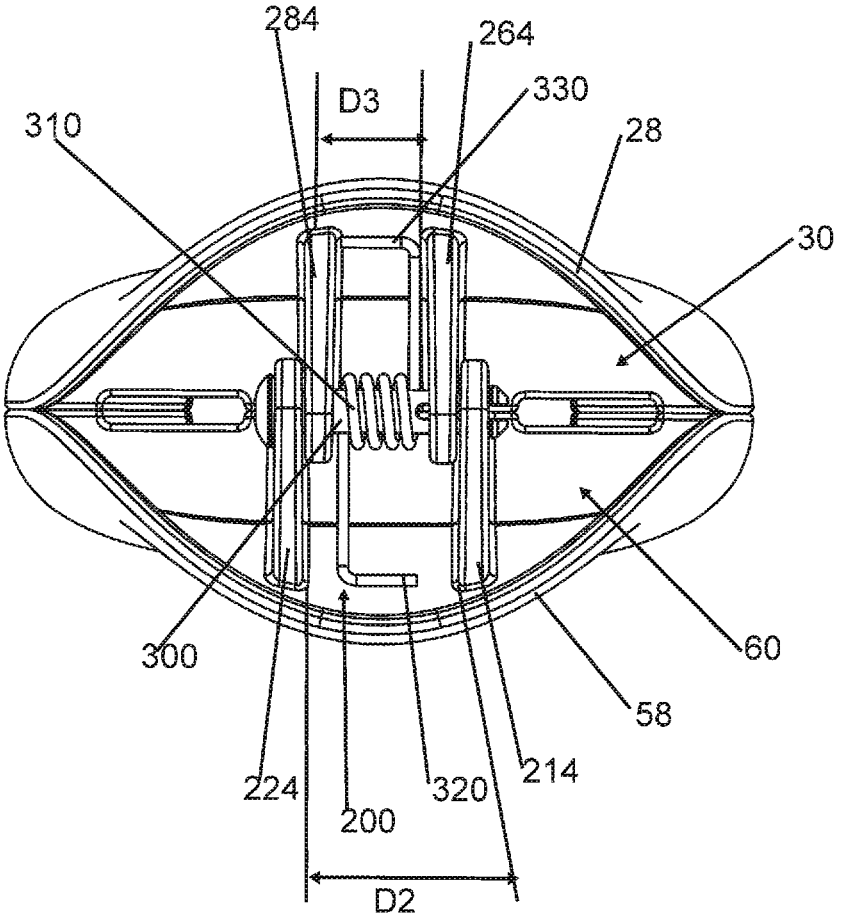
FIG. 4 is an exterior rear view of the present invention container.
Figure 5:
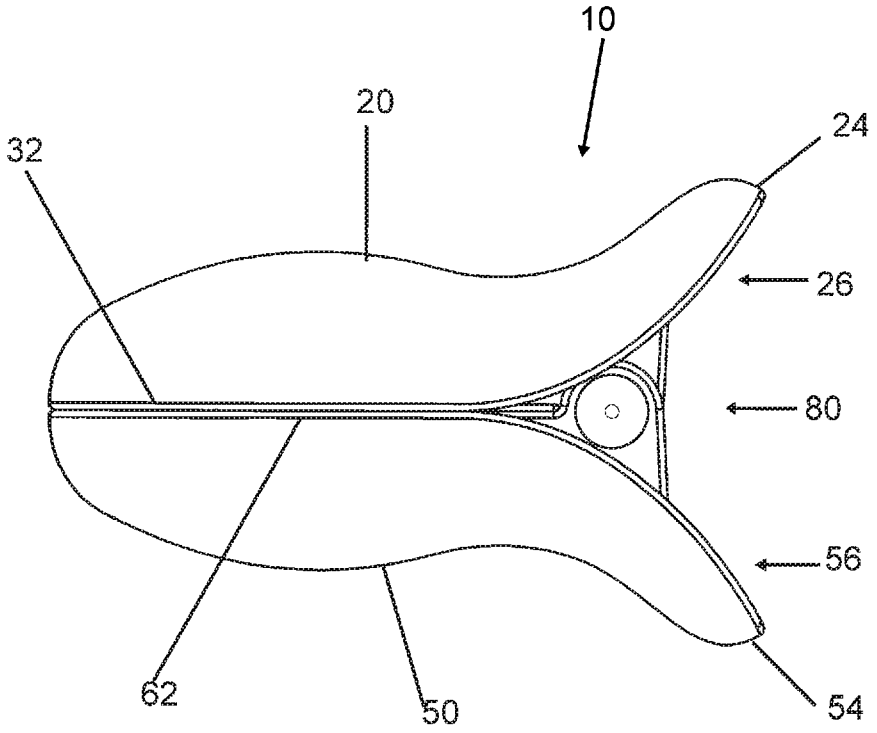
FIG. 5 is an exterior left side view of the present invention container.
Figure 6:
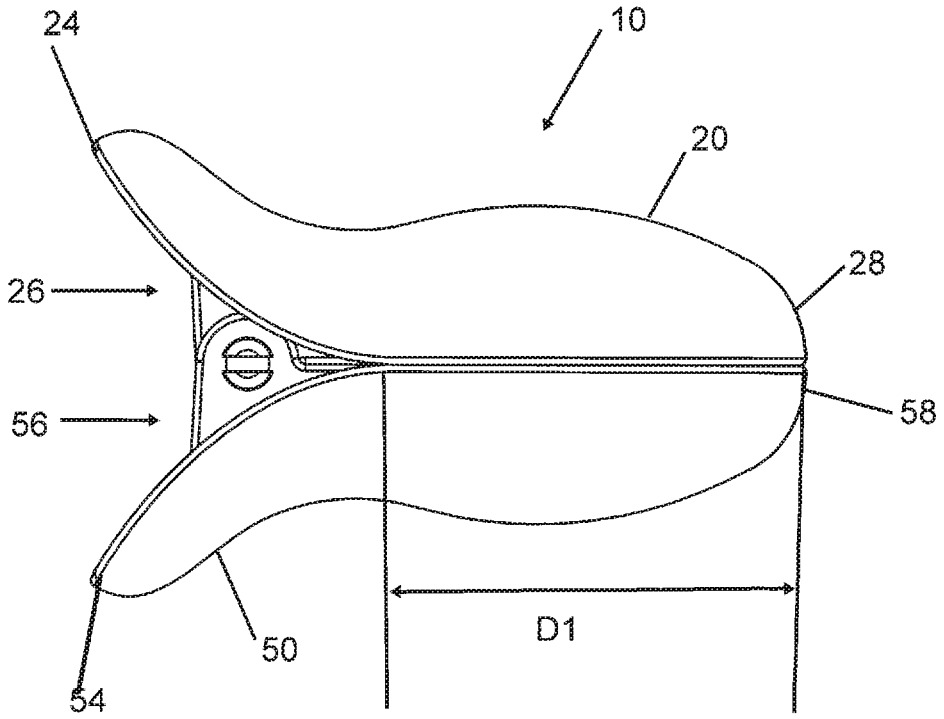
FIG. 6 is an exterior right side view of the present invention container.
Figure 7:
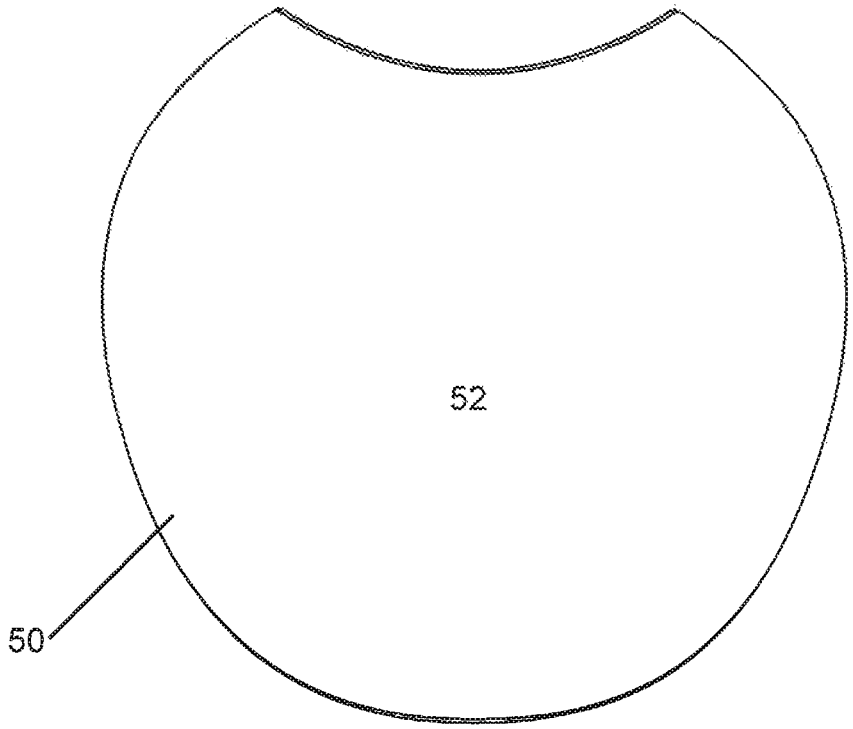
FIG. 7 is an exterior bottom plan view of the present invention container.
Figure 8:
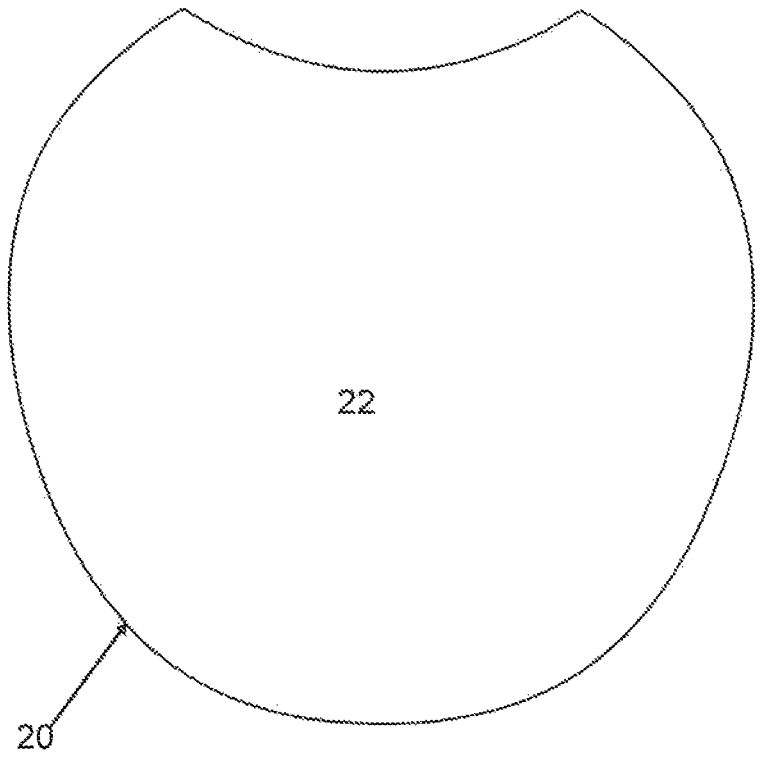
FIG. 8 is an exterior top plan view of the present invention container.

The first eight figures illustrate the present invention retainer 10 in the closed condition without a safety razorblade cartridge and handle. FIG. 1 is a top perspective view of the present invention safety razor container 10 without the safety razor cartridge retained therein. FIG. 2 is a front perspective view of the present invention safety razor container 10 without the safety razor cartridge retained therein. FIG. 3 is a top view of the present invention safety razor container 10 without the safety razor cartridge retained therein. FIG. 4 is a bottom view of the present invention safety razor container 10 without the safety razor cartridge retained therein. FIG. 5 is a right side view of the present invention safety razor container 10 without the safety razor cartridge retained therein. FIG. 6 is a left side view of the present invention safety razor container 10 without the safety razor cartridge retained therein. FIG. 7 is a front view of the present invention safety razor container 10 without the safety razor cartridge retained therein. FIG. 8 is a rear view of the present invention safety razor container without the safety razor cartridge retained therein.

Referring to FIGS. 1 through 8, the components of the present invention container will be described. The container 10 is a two-piece apparatus with a top section and a bottom section retained together by a closing force of a coil spring. The upper or top section 20 includes an exterior top surface 22, an upwardly flared rear end 24 which facilitates grasping the rear end with at least one finger of one hand, such as a thumb. The upwardly flared rear end 24 of the top surface 22 is easy to grasp with a thumb eliminating the need to have a thumb depression and thereby adding to the attractiveness of the outward appearance of the container 10. The upwardly flared rear end 24 also creates a rear opening 26. The top section 20 also includes a front end 28 with an opening 30 which constitutes a top half of a total front opening 70. The top surface also has a lower circumferential rim 32.

The container 10 further comprises a mating bottom section 50 which is a mirror image of the top section 20. The lower or bottom section 50 includes an exterior bottom surface 52, a downwardly flared rear end 54 which facilitates grasping the bottom rear end with at least one finger of one hand such as a thumb or forefinger. The downwardly flared rear end 54 of the bottom section 52 is easy to grasp with a thumb or forefinger, eliminating the need to have a finger depression and thereby adding to the attractiveness of the outward appearance of the container 10. The downwardly flared rear end 54 also creates a rear opening 56. The bottom section 50 also includes a front end 58 with an opening 60 which constitutes a bottom half of a total front opening 70. The bottom surface also has an upper circumferential rim 62.

Figure 9:
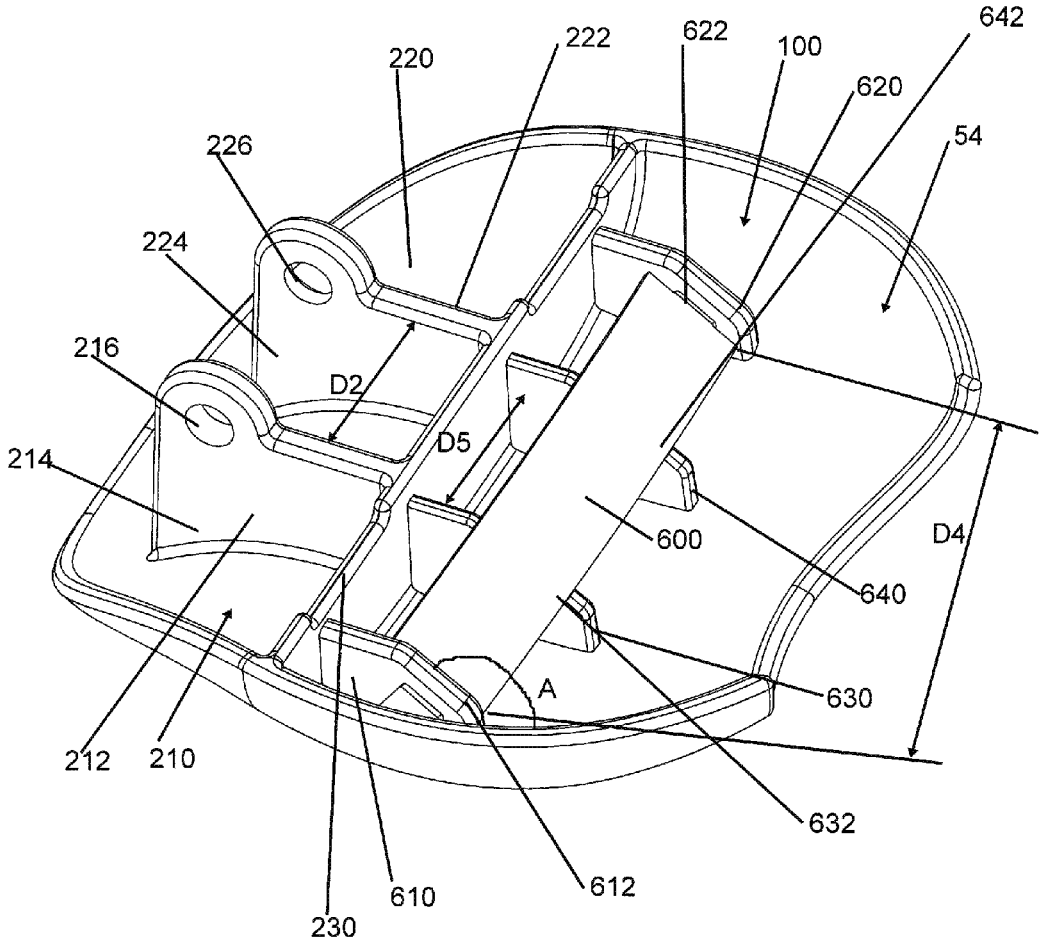
FIG. 9 an interior top-side perspective view of the present invention container with the top cover removed to illustrate the zinc strip retained within the bottom half of the present invention container.

The flared rear ends 24 and 54 are aligned mirror images of each other with respective rear openings 26 and 56 creating one larger rear opening 80. Referring to FIG. 6, the lower circumferential rim 32 of top section 20 and the upper circumferential rim 62 of bottom section 50 are aligned and touch each other for a distance "D1". The distance "D1" extends from the respective front ends 28 and 58 to a location adjacent the respective rear ends 24 and 54 before they begin to respectively flare upwardly and flare downwardly Referring to FIGS. 4, 5, 6, 9, 10 and 11, the top section 20 and bottom section 50 are aligned to surround a lower interior chamber 100 and an upper interior chamber 110 (see FIG. 11). A spring-biased opening and closing assembly 200 includes the follow components. Referring to FIG. 9, the bottom section 50 includes an interior bottom surface 54 with a first retaining boss 210 having a first leg 212 affixed to the interior bottom surface 54 and affixed to an interior transverse wall 230, the first retaining boss 210 having a rear post 214 having a first opening 216. The opening and closing assembly 200 further includes a second retaining boss 220 having a second leg 222 affixed to the interior bottom surface 54 and to the interior transverse wall 230, the second retaining boss 220 having a rear post 224 having a second opening 226. Referring to FIGS. 4 and 9, the first retaining boss 210 and second retaining boss 220 are parallel to each other and spaced apart by a distance "D2". Respective openings 216 and 226 are aligned with each other.

Figure 10:
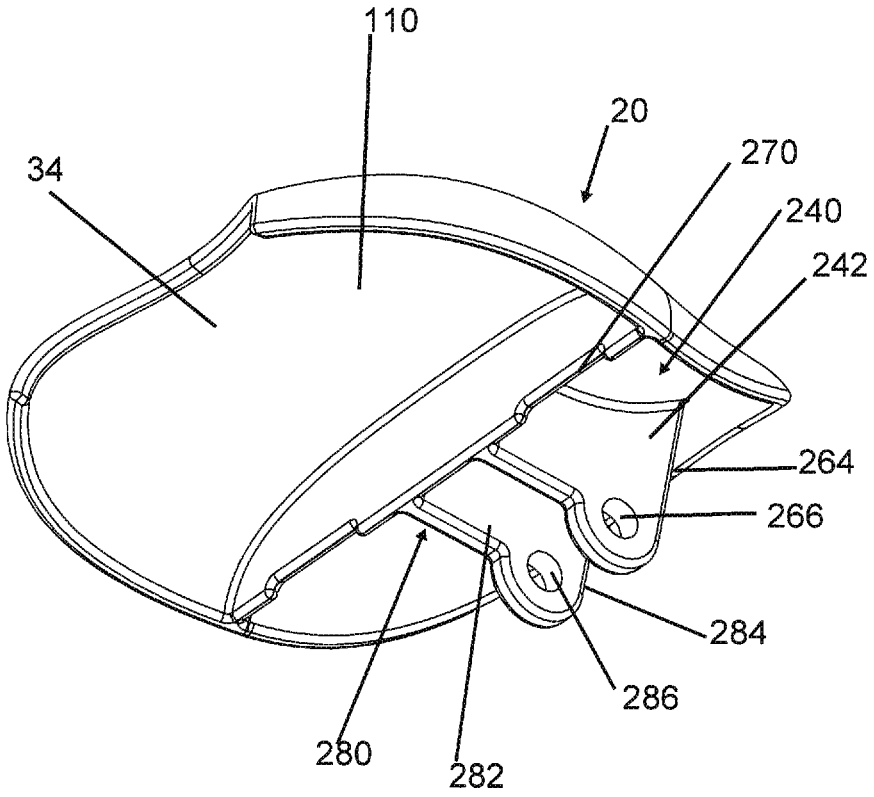
FIG. 10 an interior bottom-side perspective view of the present invention container with the bottom cover removed.

Referring to FIGS. 4 and 10, the spring biasing closing assembly includes the following additional components. The top section 20 includes an interior top surface 34 with a third retaining boss 240 having a third leg 242 affixed to the interior top surface 34 and affixed to an interior transverse wall 270. The third retaining boss 240 has a rear post 264 having a third opening 266. The opening and closing assembly 200 further includes a fourth retaining boss 280 having a fourth leg 282 affixed to the interior top surface 34 and an interior transverse wall 270, the fourth retaining boss 280 having a rear post 284 having a fourth opening 286. The third retaining boss 240 and fourth retaining boss 280 are parallel to each other and spaced apart by a distance "D3". Respective openings 266 and 286 are aligned with each other.

Distance "D3" is smaller than distance "D2" so the openings are aligned in the following order: 216, 286, 266 and 226. A dowel, retaining bolt or comparable transverse member 300 extends through the four openings 216, 286, 266 and 226 respectively located in four posts 214, 284, 264, and 224. A closing force member such as coil spring 310 is wound around dowel 300 and has spring ends, of which a first spring end 320 rests against lower interior surface 54 of bottom section 50 adjacent rear end 54 and a second spring end 330 rests against interior upper surface 34 of top section 20.

The closing force member or closing spring force 310 forces the top section 20 and bottom section 50 of the container 10 together so that the container is in the closed position. A squeezing force on the upwardly flared rear end 24 and downwardly flared rear end 54 overcomes the bias spring closing force and forces the top section 20 away from the bottom section 50 with the dowel 300 acting as the fulcrum about which the top section 20 and bottom section 50 rotate.

Referring to FIG. 9, the container 10 is shown with the interior of the bottom section 50 with the top section removed. The lower interior chamber 100 within the bottom section 50 houses a key innovation of the present invention container which is a strip of metal 600 made of zinc or zinc alloy which is retained in a fixed condition between first interior retaining arm 610 and second interior retaining arm 620 and supported by two interior support members 630 and 640. The support arms 610 and 620 are parallel and spaced apart by a distance "D4". Interior support members 630 and 640 are parallel and spaced part by distance "D5" which is less than distance D4. Interior support members 630 and 640 each have a respective retaining depression 632 and 642 into which first zinc metal strip or zinc strip 600 rests and interior support arms 610 and 620 each have respective slots 612 and 622 which retain opposite ends of the zinc strip 600. Through interior support arms 610 and 620 and interior support members 630 and 640, zinc strip 600 is retained in a fixed position at an angle "A" which is forty-five (45) degrees relative to interior surface 54. It is within the spirit and scope of the present invention for the angle "A" to range between twenty (20) degrees and seventy (70) degrees.

Referring to FIG. 10, the container 10 is illustrated from a bottom-side perspective view of top section 20. The top section 20 includes an interior top surface 34 with the third retaining boss 240 having a third leg 242 affixed to the interior top surface 34 and an interior transverse wall 270. The third retaining boss 240 having a rear post 264 having a third opening 266. The opening and closing assembly 200 further includes a fourth retaining boss 280 having a fourth leg 282 affixed to the interior top surface 34 and an interior upper transverse wall 270, the fourth retaining boss 280 having a rear post 284 having a fourth opening 286.

Figure 11:
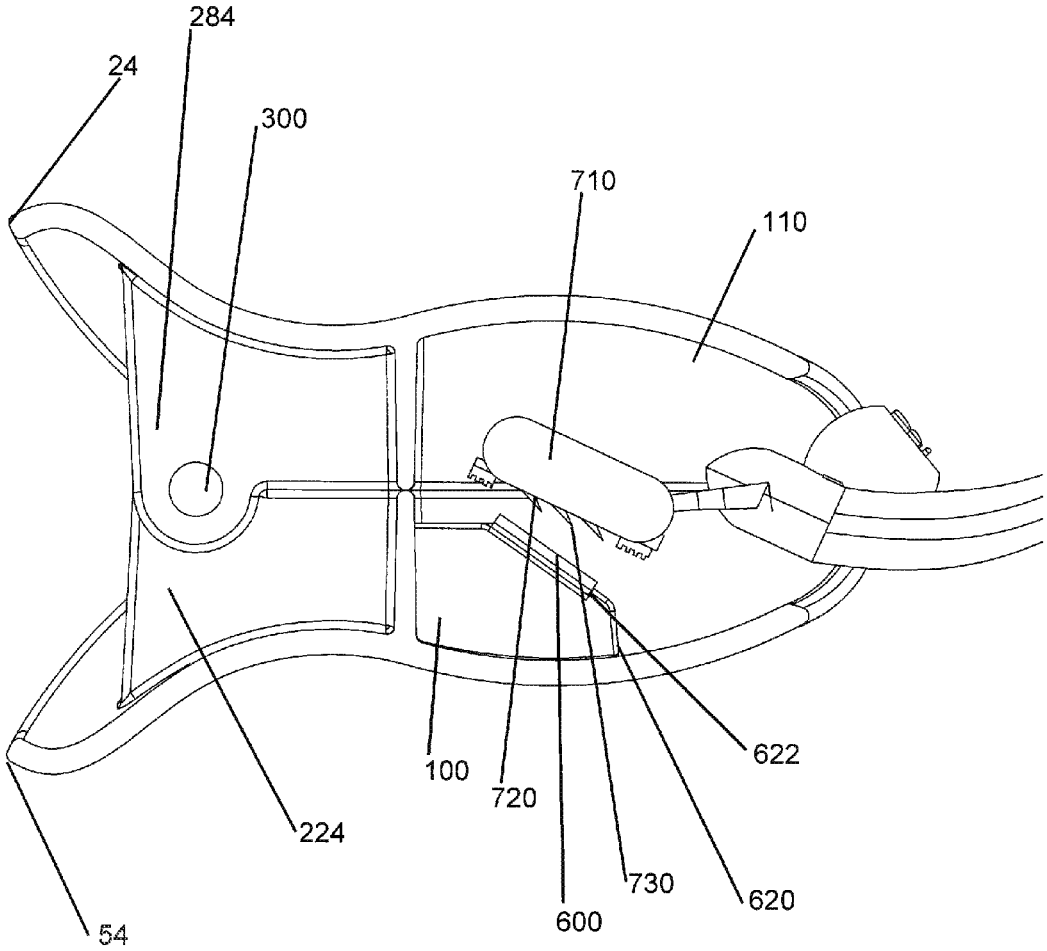
FIG. 11 is a longitudinal cross-sectional view of the present invention container illustrating a cross-sectional view of the shaver cartridge with razorblades forced adjacent the zinc strip.
Figure 12:
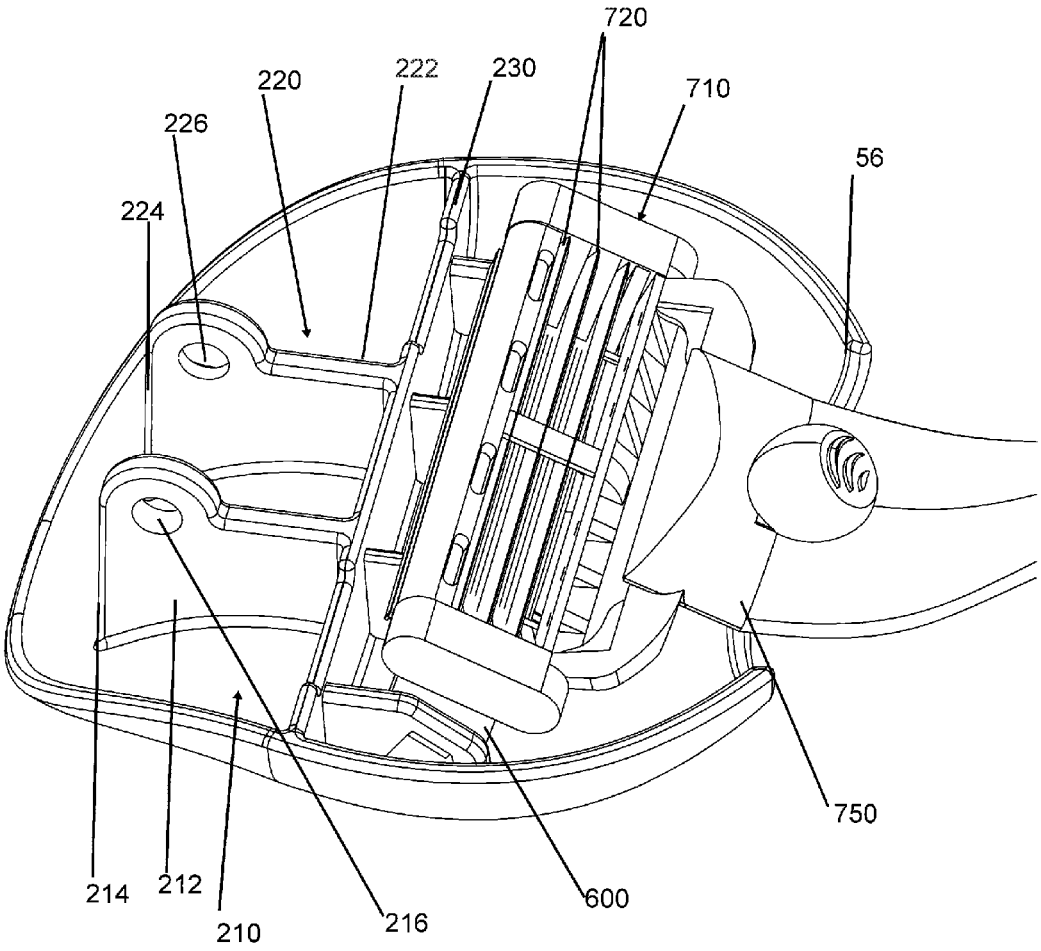
FIG. 12 is a top-side view of the present invention container with the top section removed, the shaver cartridge with razorblades forced adjacent the zinc strip, also illustrating a portion of the safety razor handle retained within the present invention container and a portion of the safety razor handle extending out of the present invention container.

Referring to FIGS. 11 and 12, a safety razor 700 is inserted into the interior chamber 100, so that a razorblade cartridge 710 rests partially with lower interior chamber 100 and partially within upper interior chamber 110. A razorblade 720 within the razorblade cartridge 710 faces into the interior chamber 100 so that the tips 730 of the razorblades 720 either touch the zinc strip 600 or are adjacent to the zinc strip 600 toward the interior surface 54 of bottom section 50. There, the closing force of the biasing spring forces the sharp edge of at least one razorblade against the strip of metal made of zinc 600.

Figure 13:
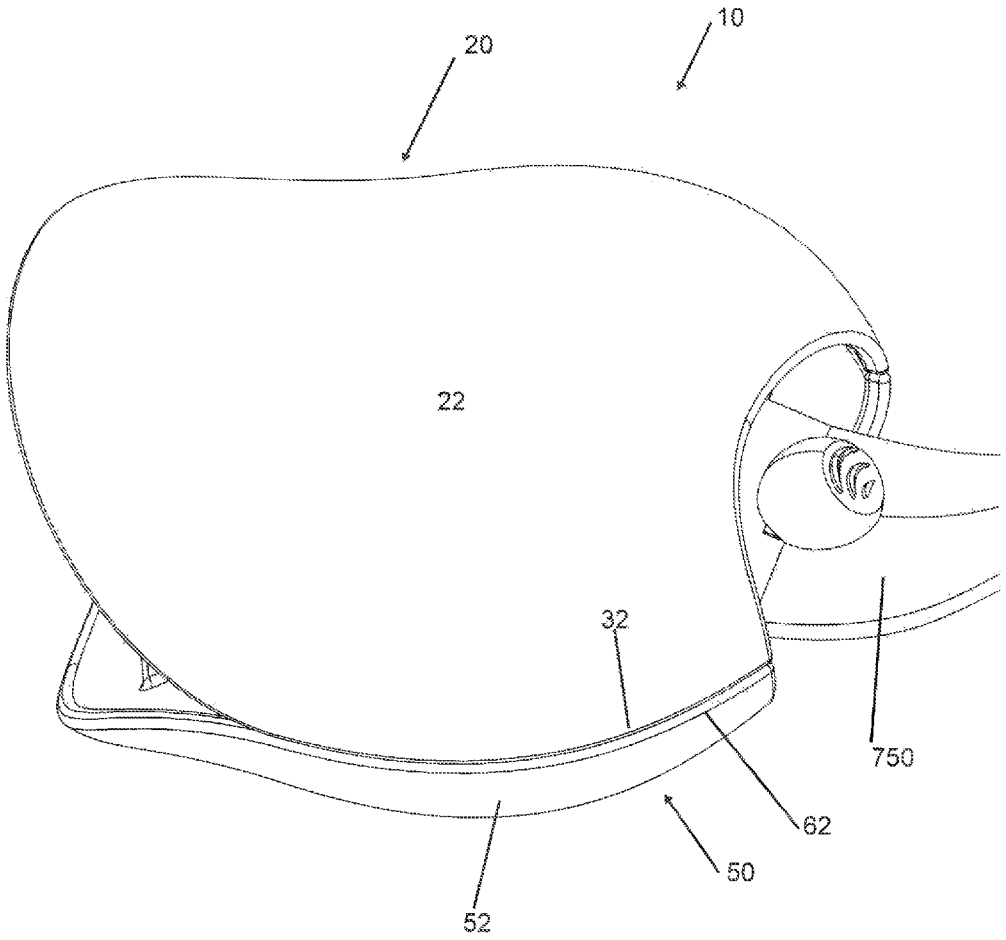
FIG. 13 is an exterior top-side perspective view of the present invention container in the closed condition with a portion of the safety razor handle extending out of the front end of the present invention container.

As illustrated in FIGS. 11, 12 and 13, the at least one razorblade cartridge 710 is attached to a handle 750 which is partially within the container 10 and partially extends out of the container 10, the safety razor retained in a manner so that the safety razor is ready for immediate use when the container is opened by a force which overcomes the closing spring force. The innovation is two-fold. First, the container is spring-biased closed so that a handle for a multiplicity of safety razorblade cartridges can be retained with the pointed end of the blades facing downwardly and securely retained against the metal strip made of zinc 600 to reduce oxidation and corrosion of the razorblades and enables the razorblades to remain in a sharp condition. Through overcoming the spring biasing force by pressing on the back of the container, the back of the cartridge is exposed and the handle of a safety razor which is attached to the razorblade cartridge can then be removed so that the container can be closed after the razorblade cartridge and attached handle have been removed.

By providing a container 10 which retains the tips 730 of the razorblades 720 in the razorblade cartridge 710 against or in close proximity to a zinc strip 600, oxidation, corrosion and other chemical reactions which deteriorate the razorblades 720 are significantly reduced.

In addition, a safety razor handle 750 is attached to the razorblade cartridge so that a person won't cut himself on the razorblades 720. A safety razor handle 750 is attached to the razorblade cartridge 720 and rests partially within the interior chambers 100 and 110 and extends out of the opening 70 formed by partial openings 26 and 56.

Referring to FIG. 13, the container 10 is illustrated in the closed position with a portion of the handle 750 extending out of the opening 70 formed by partial openings 26 and 46.

To use the safety razor, the container 10 is opened by a force to overcome the spring biasing closing force as previously described and when the container 10 is in the opened condition, the safety razor 200 can be quickly removed and is ready for immediate use. The zinc strip 6001 assures that the razorblades 720 will remain free of germs. The container 10 can be made out of material selected from the group consisting of plastic polyethylene and metal.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A container used in conjunction with a safety razor having a razorblade cartridge containing at least one razorblade having a sharp front edge, the razorblade cartridge retained by a handle having a first portion with a proximal end affixed to the razorblade cartridge and the handle having a second portion with a distal end located remote from the razorblade cartridge, the container comprising:

a. a two-piece apparatus with a top section and a mating bottom section retained together by a closing force of a coil spring assembly;

b. the top section includes an exterior top surface, an interior top surface, an upwardly flared rear end creating a top rear opening, the top section also including a front end with an opening which forms a top-half of a total front opening, the top section also having a lower circumferential rim;

c. a mating bottom section which is a mirror image of the top section, the bottom section having an exterior bottom surface, an interior bottom surface, a downwardly flared rear end creating a bottom rear opening, the mating bottom section also including a front end with an opening which forms a bottom-half of the total front opening, the bottom section also having an upper circumferential rim;

d. the upwardly flared rear end and the downwardly flared rear end are aligned mirror images of each other with respective rear openings creating one large rear opening, the lower circumferential rim of the top section and the upper circumferential rim of bottom section are aligned and when the container is in a closed condition, the lower circumferential rim and the upper circumference rim touch each other for a first distance which extends from respective front ends of the top second and the mating bottom section to a location adjacent said respective rear ends before the respective rear ends begin to respectively flare upwardly and flair downwardly;

e. in a container closed condition, container interior chamber is bounded said interior top surface and said interior bottom surface, the lower circumferential rim of the top section and the upper circumferential rim of bottom section are aligned and touch each other to form a circumferential boundary of said interior chamber;

f. said coil spring assembly including a first retaining boss having a first leg affixed to both said interior bottom surface and to a lower interior transverse wall, the first retaining boss having a rear post having a first opening, a second retaining boss having a second leg affixed to both said interior bottom surface and to the lower interior transverse wall, the second retaining boss having a rear post having a second opening, the first retaining boss and the second retaining boss parallel to each other and spaced apart by a second distance with the first opening aligned with the second opening, the top section including a third retaining boss having a third leg affixed to both said upper interior surface and affixed to an upper interior transverse wall, the third retaining boss having a third rear post having a third opening, and a fourth retaining boss having a fourth leg affixed to both the upper interior surface and an upper interior transverse wall, the fourth retaining boss having a fourth rear post having a fourth opening, the third and fourth retaining bosses are parallel to each other and spaced apar by a third distance with the third opening aligned with the fourth opening, a transverse retaining member through first opening, third opening, fourth opening and second opening, a coil spring wound around said transverse retaining member with a first spring end resting against said lower interior surface and a second spring end resting against said upper interior upper surface, the coil spring assembly creating a closing force to place said container into said closed condition with said upper rim touching said lower rim, the respective front openings of the top section and the mating bottom section form said total front opening and the top rear opening and bottom rear opening form a total rear opening; and g. a strip of metal made of zinc which is retained in a fixed condition between a first interior retaining arm and a spaced apart second interior retaining arm and supported by two spaced apart interior support members located between said first interior retaining arm and said spaced apart second interior retaining arm, the strip of metal made of zinc retained in a fixed position at a downward angle toward said interior bottom surface;

h. whereby, a downward pressure on said upwardly flared rear end and an upward pressure on said downwardly flared end overcomes the coil spring assembly closing force and causes the top section to rotate about said transverse retaining member and the mating bottom retaining section to rotate about said transverse retaining member to separate the upper front end and lower circumferential rim to separate from said lower front end and said upper circumferential rim to a container open condition, and said razorblade cartridge containing at least one razorblade with a front sharp edge is inserted into said interior chamber with the sharp edge of the at least one razorblade touching said strip of metal made of zinc, the front portion of the handle retained within said interior chamber and the second portion of said handle extending out of said total from opening, and when the upward and downward pressure are released, the coil spring assembly forces said top section and the mating bottom section into a closed position and causes the sharp edge of said at least one razorblade to remain touching the strip of metal made of zinc.

2. The container in accordance with claim 1, further comprising: said downward angle of said strip of metal made of zinc is 45 degrees.

3. The container in accordance with claim 1, further comprising: said downward angle of said strip of metal made of zinc is in a range from approximately 20 degrees to approximately 70 degrees.

4. A container used in conjunction with a safety razor having a razorblade cartridge containing at least one razorblade having a sharp front edge, the container comprising:

a. a two-piece apparatus with a top section and a mating bottom section retained together by a closing force member;

b. the top section includes an exterior top surface, an interior top surface, an upwardly flared rear end and a front end with a front opening, and a lower circumferential rim;

c. a mating bottom section includes an exterior bottom surface, an interior bottom surface, a downwardly flared rear end and a front end with a front opening, and an upper circumferential rim d. in a container closed condition, container interior chamber is bounded said interior top surface and said interior bottom surface, the lower circumferential rim of the top section and the upper circumferential rim of bottom section are aligned and touch each other to form a circumferential boundary of said interior chamber;

e. said closing force member is retained within said interior chamber; and f. a metal zinc strip is retained in a fixed condition between a first interior retaining member and a spaced apart second interior retaining member;

g. whereby, when said razorblade cartridge is inserted into said container interior chamber with the sharp edge of said at least one razor blade facing said zinc metal strip, the closing force of said closing member retains said sharp edge of said at least one razorblade against said zinc metal strip.

5. The container in accordance with claim 4, further comprising: said zinc metal strip is retained at a downward angle relative to said interior bottom surface.

6. The container in accordance with claim 5, further comprising: said downward angle of said strip of metal made of zinc is 45 degrees.

7. The container in accordance with claim 5, further comprising: said downward angle of said strip of metal made of zinc is in a range from approximately 20 degrees to approximately 70 degrees.

8. The container in accordance with claim 4, further comprising: said zinc metal strip is further supported by two spaced apart interior support members located between said first interior retaining and said spaced apart second interior retaining member.

9. The container in accordance with claim 4, further comprising: said first retaining arm and said spaced apart second retaining arm are each affixed to said interior bottom surface.

10. The container in accordance with claim 4, further comprising: said closing force member is a coil spring.

11. The container in accordance with claim 4, further comprising: said closing member includes a first retaining boss having a first leg affixed to at least said interior bottom surface the first retaining boss having a rear post having a first opening, a second retaining boss having a second leg affixed to at least said interior bottom surface, the second retaining boss having a rear post having a second opening, the first retaining boss and the second retaining boss parallel to each other and spaced apart with the first opening aligned with the second opening, the top section including a third retaining boss having a third leg affixed to at least to said upper interior surface, the third retaining boss having a third rear post having a third opening, and a fourth retaining boss having a fourth leg affixed to at least the upper interior surface, the fourth retaining boss having a fourth rear post having a fourth opening, the third and fourth retaining bosses are parallel to each other and the third opening aligned with the fourth opening, a transverse retaining member by retained through the respective first opening, second opening, third opening and fourth opening, a coil spring wound around said transverse retaining member with a first spring end resting against said lower interior surface and a second spring end resting against said upper interior upper surface.

12. A container used in conjunction with a safety razor having a razorblade cartridge containing at least one razorblade having a sharp front edge, the container comprising:

a. a two-piece apparatus with a top section and a mating bottom section retained together by a closing force member;

b. the top section includes an exterior top surface, an interior top surface, an upwardly flared rear end, and a lower circumferential rim;

c. a mating bottom section includes an exterior bottom surface, an interior bottom surface, a downwardly flared rear end and an upper circumferential rim;

d. in a container closed condition, container interior chamber is bounded said interior top surface and said interior bottom surface, the lower circumferential rim of the top section and the upper circumferential rim of bottom section are aligned and touch each other to form a circumferential boundary of said interior chamber;

e. said closing force member is retained within said interior chamber; and f. a metal zinc strip is retained in a fixed condition within said interior chamber;

g. whereby, when said razorblade cartridge is inserted into said container interior chamber with the sharp edge of said at least one razor blade facing said zinc metal strip, the closing force of said closing member retains said sharp edge of said at least one razorblade at least adjacent said zinc metal strip.

13. The container in accordance with claim 12, further comprising: said zinc metal strip is retained at a downward angle relative to said interior bottom surface.

14. The container in accordance with claim 13, further comprising: said downward angle of said strip of metal made of zinc is 45 degrees.

15. The container in accordance with claim 13, further comprising: said downward angle of said strip of metal made of zinc is in a range from approximately 20 degrees to approximately 70 degrees.

16. The container in accordance with claim 12, further comprising: said closing force member is a coil spring.

* * * * *